US009127333B2

(12) United States Patent
Jacobsen et al.

(10) Patent No.: US 9,127,333 B2
(45) Date of Patent: Sep. 8, 2015

(54) LIQUID INJECTION OF $VCL_4$ INTO SUPERHEATED $TICL_4$ FOR THE PRODUCTION OF TI-V ALLOY POWDER

(76) Inventors: Lance Jacobsen, Minooka, IL (US); Adam Benish, Joliet, IL (US)

( * ) Notice: Subject to any disclaimer, the term of this patent is extended or adjusted under 35 U.S.C. 154(b) by 2180 days.

(21) Appl. No.: 11/789,641

(22) Filed: Apr. 25, 2007

(65) Prior Publication Data

US 2008/0264208 A1 Oct. 30, 2008

(51) Int. Cl.

| | |
|---|---|
| ***C22B 34/12*** | (2006.01) |
| ***C22B 34/10*** | (2006.01) |
| ***B22F 9/28*** | (2006.01) |
| ***C22B 5/04*** | (2006.01) |
| ***C22B 34/22*** | (2006.01) |
| ***C22C 1/04*** | (2006.01) |

(52) U.S. Cl.

CPC ..... *C22B 34/1272* (2013.01); *B22F 9/28* (2013.01); *C22B 5/04* (2013.01); *C22B 34/22* (2013.01); *C22C 1/0458* (2013.01); *B22F 2999/00* (2013.01)

(58) Field of Classification Search

None

See application file for complete search history.

(56) References Cited

U.S. PATENT DOCUMENTS

| | | | |
|---|---|---|---|
| 1,771,928 | A | 7/1930 | Jung |
| 2,205,854 | A | 6/1940 | Kroll |
| 2,607,675 | A | 8/1952 | Gross |
| 2,647,826 | A | 8/1953 | Jordan |
| 2,816,828 | A | 12/1957 | Benedict et al. |
| 2,823,991 | A | 2/1958 | Kamlet |
| 2,827,371 | A | 3/1958 | Quin |
| 2,835,567 | A | 5/1958 | Willcox |
| 2,846,303 | A | 8/1958 | Keller et al. |
| 2,846,304 | A | 8/1958 | Keller et al. |
| 2,882,143 | A | 4/1959 | Schmidt |
| 2,882,144 | A | 4/1959 | Follows et al. |
| 2,890,112 | A | 6/1959 | Winter |
| 2,895,823 | A | 7/1959 | Lynskey |

(Continued)

FOREIGN PATENT DOCUMENTS

| | | |
|---|---|---|
| AU | 587782 | 11/1985 |
| AU | 2003263081 | 6/2004 |

(Continued)

OTHER PUBLICATIONS

Stratcor MSDS sheet (http://www.stratcor.com/chemicals/VCL4-MSDS-English-7-1-07c.pdf).*

(Continued)

*Primary Examiner* — Yoshitoshi Takeuchi

(74) *Attorney, Agent, or Firm* — Dunlap Codding, P.C.

(57) ABSTRACT

A method and system for producing an alloy using a flowing stream of superheated halide vapor to flash vaporize liquid halides forming a mixture of gases in predetermined and controllable ratios. The mixture of gases are introduced into a flowing stream of liquid alkali or alkaline earth metal or mixtures to establish a reaction zone where the mixture of gases is reduced to an alloy and a salt. The liquid metal is in a sufficient amount in excess of stoichiometric to maintain substantially all the alloy and salt below the sintering temperatures thereof away from the reaction zone. Equipment for practicing the method is also disclosed. The system relates to alloys of B, Be, Bi, C, Fe, Ga, Ge, Hf, In, Mo, Nb, P, Pb, Re, S, Sb, Si, Sn, Ta, Ti, V, W and Zr.

22 Claims, 6 Drawing Sheets

(56) References Cited

U.S. PATENT DOCUMENTS 2,915,382 A 12/1959 Hellier et al.
2,941,867 A 6/1960 Maurer
2,944,888 A 7/1960 Quin
3,058,820 A 10/1962 Whitehurst
3,067,025 A 12/1962 Chisholm
3,085,871 A 4/1963 Griffiths
3,085,872 A 4/1963 Kenneth
3,113,017 A 12/1963 Homme
3,331,666 A 7/1967 Robinson et al.
3,519,258 A 7/1970 Ishizuka
3,535,109 A 10/1970 Ingersoll
3,650,681 A 3/1972 Sugahara et al.
3,825,415 A 7/1974 Johnston et al.
3,836,302 A 9/1974 Kaukeinen
3,847,596 A 11/1974 Holland et al.
3,867,515 A 2/1975 Bohl et al.
3,919,087 A 11/1975 Brumagim
3,927,993 A 12/1975 Griffin
3,943,751 A 3/1976 Akiyama et al.
3,966,460 A 6/1976 Spink
4,007,055 A 2/1977 Whittingham
4,009,007 A 2/1977 Fry
4,017,302 A 4/1977 Bates et al.
4,070,252 A 1/1978 Bonsack
4,128,421 A 12/1978 Marsh et al.
4,141,719 A 2/1979 Hakko
4,149,876 A 4/1979 Rerat
4,190,442 A 2/1980 Patel
4,331,477 A 5/1982 Kubo et al.
4,379,718 A 4/1983 Grantham et al.
4,401,467 A 8/1983 Jordan
4,402,741 A 9/1983 Pollet et al.
4,414,188 A 11/1983 Becker
4,423,004 A 12/1983 Ross
4,425,217 A 1/1984 Beer
4,432,813 A 2/1984 Williams
4,445,931 A 5/1984 Worthington
4,454,169 A 6/1984 Hinden et al.
4,518,426 A 5/1985 Murphy
4,519,837 A 5/1985 Down
4,521,281 A 6/1985 Kadija
4,555,268 A 11/1985 Getz
4,556,420 A 12/1985 Evans et al.
4,604,368 A 8/1986 Reeve
4,606,902 A 8/1986 Ritter
RE32,260 E 10/1986 Fry
4,687,632 A 8/1987 Hurd
4,689,129 A 8/1987 Knudsen
4,725,312 A 2/1988 Seon et al.
4,828,008 A 5/1989 White et al.
4,830,665 A 5/1989 Winand
4,839,120 A 6/1989 Baba et al.
4,877,445 A 10/1989 Okudaira et al.
4,897,116 A 1/1990 Scheel
4,902,341 A 2/1990 Okudaira et al.
4,915,729 A 4/1990 Boswell et al.
4,923,577 A 5/1990 McLaughlin et al.
4,940,490 A 7/1990 Fife et al.
4,941,646 A 7/1990 Stelts et al.
4,985,069 A 1/1991 Traut
5,028,491 A 7/1991 Huang et al.
5,032,176 A 7/1991 Kametani et al.
5,055,280 A 10/1991 Nakatani et al.
5,064,463 A 11/1991 Ciomek
5,082,491 A 1/1992 Rerat
5,147,451 A 9/1992 Leland
5,149,497 A 9/1992 McKee et al.
5,160,428 A 11/1992 Kuri
5,164,346 A 11/1992 Giunchi et al.
5,167,271 A 12/1992 Lange et al.
5,176,741 A 1/1993 Bartlett et al.
5,176,810 A 1/1993 Volotinen et al.
5,211,741 A 5/1993 Fife
5,259,862 A 11/1993 White et al.
5,338,379 A 8/1994 Kelly
5,356,120 A 10/1994 König et al.
5,427,602 A 6/1995 DeYoung et al.
5,437,854 A 8/1995 Walker et al.
5,439,750 A 8/1995 Ravenhall et al.
5,448,447 A 9/1995 Chang
5,460,642 A 10/1995 Leland
5,498,446 A 3/1996 Axelbaum et al.
5,580,516 A 12/1996 Kumar
H1642 H 4/1997 Ogden
5,637,816 A 6/1997 Schneibel
5,779,761 A * 7/1998 Armstrong et al. ..... 75/370
5,897,830 A 4/1999 Abkowitz et al.
5,914,440 A 6/1999 Celik et al.
5,948,495 A 9/1999 Stanish et al.
5,951,822 A 9/1999 Knapick et al.
5,954,856 A 9/1999 Pathare et al.
5,958,106 A 9/1999 Armstrong et al.
5,986,877 A 11/1999 Pathare et al.
5,993,512 A 11/1999 Pargeter et al.
6,010,661 A 1/2000 Abe et al.
6,027,585 A 2/2000 Patterson et al.
6,040,975 A 3/2000 Mimura
6,099,664 A 8/2000 Davies
6,103,651 A 8/2000 Leitzel
6,136,062 A 10/2000 Loffeholz et al.
6,180,258 B1 1/2001 Klier
6,193,779 B1 2/2001 Reichert et al.
6,210,461 B1 4/2001 Elliott
6,238,456 B1 5/2001 Wolf et al.
6,309,570 B1 10/2001 Fellabaum
6,309,595 B1 10/2001 Rosenberg et al.
6,409,797 B2 6/2002 Armstrong et al.
6,432,161 B1 8/2002 Oda et al.
6,488,073 B1 12/2002 Blenkinsop et al.
6,502,623 B1 1/2003 Schmitt
6,602,482 B2 8/2003 Kohler et al.
6,689,187 B2 2/2004 Oda
6,727,005 B2 4/2004 Gimondo et al.
6,745,930 B2 6/2004 Schmitt
6,824,585 B2 11/2004 Joseph et al.
6,861,038 B2 3/2005 Armstrong et al.
6,884,522 B2 4/2005 Adams et al.
6,902,601 B2 6/2005 Nie et al.
6,921,510 B2 7/2005 Ott et al.
6,955,703 B2 10/2005 Zhou et al.
7,041,150 B2 5/2006 Armstrong et al.
7,351,272 B2 4/2008 Armstrong et al.
7,410,610 B2 8/2008 Woodfield et al.
7,435,282 B2 10/2008 Armstrong et al.
7,445,658 B2 11/2008 Armstrong et al.
7,501,007 B2 3/2009 Anderson et al.
7,501,089 B2 3/2009 Armstrong et al.
2002/0050185 A1 5/2002 Oda
2002/0152844 A1 10/2002 Armstrong et al.
2003/0061907 A1 4/2003 Armostrong et al.
2003/0145682 A1 8/2003 Anderson et al.
2004/0050208 A1 * 3/2004 Nie et al. ..... 75/369
2004/0079197 A1 * 4/2004 Armstrong et al. ..... 75/369
2004/0123700 A1 7/2004 Zhou et al.
2005/0081682 A1 * 4/2005 Armstrong et al. ..... 75/621
2005/0150576 A1 7/2005 Venigalla
2005/0225014 A1 10/2005 Armstrong et al.
2005/0284824 A1 12/2005 Anderson et al.
2006/0086435 A1 4/2006 Anderson et al.
2006/0102255 A1 5/2006 Woodfield et al.
2006/0107790 A1 * 5/2006 Anderson et al. ..... 75/351
2006/0123950 A1 6/2006 Anderson et al.
2006/0150769 A1 7/2006 Armstrong et al.
2006/0230878 A1 10/2006 Anderson et al.
2007/0017319 A1 1/2007 Jacobsen et al.
2007/0079908 A1 4/2007 Jacobsen et al.
2007/0180951 A1 8/2007 Armstrong et al.
2007/0180952 A1 8/2007 Lanin et al.
2008/0031766 A1 2/2008 Kogut et al.
2008/0152533 A1 6/2008 Ernst et al.

(56) References Cited

U.S. PATENT DOCUMENTS

| | | | |
|---|---|---|---|
| 2008/0187455 | A1 | 8/2008 | Armstrong et al. |
| 2008/0199348 | A1 | 8/2008 | Armstrong et al. |

FOREIGN PATENT DOCUMENTS

| | | |
|---|---|---|
| CA | 2196534 | 2/1996 |
| EA | 006615 | 2/2006 |
| EA | 007634 | 12/2006 |
| EP | 0298698 | 1/1989 |
| EP | 0299791 | 1/1989 |
| EP | 1441039 | 7/2004 |
| EP | 1657317 | 5/2006 |
| GB | 722184 | 1/1955 |
| GB | 778021 | 7/1957 |
| JP | 31007808 | 9/1956 |
| JP | 49042518 | 4/1974 |
| JP | 51010803 | 4/1976 |
| JP | 60255300 | 12/1985 |
| JP | 6112837 | 1/1986 |
| JP | 62065921 | 3/1987 |
| JP | 64047823 | 2/1989 |
| JP | 4116161 | 4/1992 |
| JP | 05078762 | 3/1993 |
| JP | 10502418 | 3/1998 |
| JP | 11090692 | 4/1999 |
| JP | 2001279345 | 10/2001 |
| NO | 90840 | 1/1958 |
| RU | 411962 | 1/1974 |
| WO | WO96/04407 | 2/1996 |
| WO | WO98/24575 | 6/1998 |
| WO | WO2004/022269 | 3/2004 |
| WO | WO2004/022797 | 3/2004 |
| WO | WO2004/022798 | 3/2004 |
| WO | WO2004/022799 | 3/2004 |
| WO | WO2004/022800 | 3/2004 |
| WO | WO2004/026511 | 4/2004 |
| WO | WO2004/028655 | 4/2004 |
| WO | WO2004/033736 | 4/2004 |
| WO | WO2004/033737 | 4/2004 |
| WO | WO2004/048622 | 10/2004 |
| WO | WO2005/019485 | 3/2005 |
| WO | WO2005/021807 | 3/2005 |
| WO | WO2005/023725 | 3/2005 |
| WO | WO2005/042792 | 5/2005 |
| WO | WO2007/044635 | 4/2007 |
| WO | WO2007/089400 | 8/2007 |
| WO | WO2008/013518 | 1/2008 |
| WO | WO2008/079115 | 7/2008 |

OTHER PUBLICATIONS

Crowley, How to Extract Low-Cost Titanium, Adv. Mat'l. & Processes (Nov. 2003).*

Kelto et al. "Titanium Powder Metallurgy—A Perspective"; Conference: Powder Metallurgy of Titanium Alloys, Las Vegas, Nevada, Feb. 1980, pp. 1-19.

Mahajan et al. "Microstructure Property Correlation in Cold Pressed and Sintered Elemental Ti-6A1-4V Powder Compacts"; Conference: Powder Metallurgy of Titanium Alloys, Las Vegas, Nevada, Feb. 1980, pp. 189-202.

DeKock et al. "Attempted Preparation of Ti-6-4 Alloy Powders from $TiCl_4$, Al, $VCl_4$, and Na"; Metallurgical Transactions B, vol. 18B, No. 1, Process Metallurgy, Sep. 1987, pp. 511-517.

Upadhyaya "Metal Powder Compaction", Powder Metallurgy Technology, Published by Cambridge International Science Publishing, 1997; pp. 42-67.

Moxson et al. "Production and Applications of Low Cost Titanium Powder Products"; The international Journal of Powder Metallurgy, vol. 34, No. 5, 1998, pp. 45-47.

ALT "Solid-Liquid Separation, Introduction"; Ulmann's Encyclopedia of Industrial Chemistry, © 2002 by Wiley-VCH Verlag GmbH & Co., Online Posting Date: Jun. 15, 2000, pp. 1-7.

Gerdemann et al. "Characterization of a Titanium Powder Produced Through a Novel Continuous Process"; Published by Metal Powder Industries Federation, 2000, pp. 12.41-12.52.

Moxson et al. "Innovations in Titanium Powder Processing"; Titanium Overview, JOM, May 2000, p. 24.

Gerdemann "Titanium Process Technologies"; Advanced Materials & Processes, Jul. 2001, pp. 41-43.

Lü et al. "Laser-Induced Materials and Processes for Rapid Prototyping" Published by Springer, 2001, pp. 153-154.

Lee et al. "Synthesis of Nano-Structured Titanium Carbide by Mg-Thermal Reduction"; Scripta Materialia, 2003, pp. 1513-1518.

Chandran et al. "$TiB_w$-Reinforced Ti Composites: Processing, Properties, Application Prospects, and Research Needs"; Ti—B Alloys and Composites Overview, JOM, May 2004, pp. 42-48.

Chandran et al. "Titanium-Boron Alloys and Composites: Processing, Properties, and Applications"; Ti—B Alloys and Composites Commentary, JOM, May 2004 pp. 32 and 41.

Hanusiak et al. "The Prospects for Hybrid Fiber-Reinforced Ti—TiB-Matrix Composites"; Ti—B Alloys and Composites Overview, JOM, May 2004, pp. 49-50.

Kumari et al. "High-Temperature Deformation Behavior of Ti—$TiB_w$ In-Situ Metal-Matrix Composites"; Ti—B Alloys and Composites Research Summary, JOM, May 2004, pp. 51-55.

Saito "The Automotive Application of Discontinuously Reinforced TiB—Ti Composites"; Ti—B Alloys and Composites Overview, JOM, May 2004, pp. 33-36.

Yolton "The Pre-Alloyed Powder Metallurgy of Titanium with Boron and Carbon Additions"; Ti—B Alloys and Composites Research Summary, JOM, May 2004, pp. 56-59.

Research Report; P/M Technology News, Crucible Research, Aug. 2005, vol. 1, Issue 2, 2 pages.

International Search Report (8 pages).

* cited by examiner

LIQUID INJECTION OF $VCL_4$ INTO SUPERHEATED $TICL_4$ FOR THE PRODUCTION OF TI-V ALLOY POWDER

FIELD OF THE INVENTION

This invention relates to the production of alloys.

BACKGROUND OF THE INVENTION

The present invention relates to the production of metals and alloys using the general method disclosed in U.S. Pat. Nos. 6,409,797; 5,958,106; and 5,779,761, all of which are incorporated herein, and preferably a method wherein titanium or an alloy thereof is made by the reduction of halides in a flowing liquid stream of reducing metal.

Although the process and system hereinafter described pertains to titanium base alloys, it is applicable to a wide variety of alloys, wherein a superheated halide is used to vaporize a liquid halide to form an alloy in which the constituents include the superheated halide and in the liquid halide.

The Armstrong Process is defined in the patents cited above and uses a flowing liquid metal stream into which is introduced a halide vapor. The liquid metal stream may be any one or more of the alkali metals or alkaline earth metals or mixtures thereof, however, the preferred metal is sodium because of its availability, low cost and melting point, permitting steady state operations of the process to be less than 600° C. and approaching or below 400° C. Preferred alternates are potassium or NaK while Mg and Ca are preferred alkaline earth metals. One very important commercial aspect of the Armstrong Process as disclosed in the above-referenced and incorporated patents is the ability to make almost any alloy wherein the constituents can be introduced as vapor into the flowing liquid metal. For titanium and its alloys, the most common commercial alloy is what is known as 6-4 alloy, that is 6% percent by weight aluminum, 4% by weight vanadium with the balance titanium, the ASTM B265 classifications for Ti are set forth in Table 1 hereafter (Class 5 is alloy 6-4). The ASTM 265 classification for commercially pure (CP) titanium is Class 2.

TABLE 1

Chemical Requirements

| | Composition % Grade | | | | | | | | | |
|---|---|---|---|---|---|---|---|---|---|---|
| Element | 1 | 2 | 3 | 4 | 5 | 6 | 7 | 8 | 9 | 10 |
| Nitrogen max | 0.03 | 0.03 | 0.05 | 0.05 | 0.05 | 0.05 | 0.03 | 0.02 | 0.03 | 0.03 |
| Carbon max | 0.10 | 0.10 | 0.10 | 0.10 | 0.10 | 0.10 | 0.10 | 0.10 | 0.10 | 0.08 |
| Hydrogen[B] max | 0.015 | 0.015 | 0.015 | 0.015 | 0.015 | 0.020 | 0.015 | 0.015 | 0.015 | 0.015 |
| Iron Max | 0.20 | 0.30 | 0.30 | 0.50 | 0.40 | 0.50 | 0.30 | 0.25 | 0.20 | 0.30 |
| Oxygen max | 0.18 | 0.25 | 0.35 | 0.40 | 0.20 | 0.20 | 0.25 | 0.15 | 0.18 | 0.25 |
| Aluminum | . . . | . . . | . . . | . . . | 5.5 to 6.75 | 4.0 to 6.0 | . . . | 2.5 to 3.5 | . . . | . . . |
| Vanadium | . . . | . . . | . . . | . . . | 3.5 to 4.5 | . . . | . . . | | 2.0 to 3.0 | |
| Tin | . . . | . . . | . . . | . . . | . . . | 2.0 to 3.0 | . . . | . . . | . . . | . . . |
| Palladium | . . . | . . . | . . . | . . . | . . . | . . . | 0.12 to 0.25 | . . . | 0.12 to 0.25 | . . . |
| Molybdenum | . . . | . . . | . . . | . . . | . . . | . . . | . . . | . . . | . . . | 0.2 to 0.4 |
| Zirconium | . . . | . . . | . . . | . . . | . . . | . . . | . . . | . . . | . . . | . . . |
| Nickel | . . . | . . . | . . . | . . . | . . . | . . . | . . . | . . . | . . . | 0.6 to 0.9 |
| Residuals[C,D,E.] (each), max | 0.1 | 0.1 | 0.1 | 0.1 | 0.1 | 0.1 | 0.1 | 0.1 | 0.1 | 0.1 |
| Residuals[C,D,E] (total) max | 0.4 | 0.4 | 0.4 | 0.4 | 0.4 | 0.4 | 0.4 | 0.4 | 0.4 | 0.4 |
| Titanium[F] | remainder | remainder | remainder | remainder | remainder | remainder | remainder | remainder | remainder | remainder |

[A]Analysis shall be completed for all elements listed in this Table for each grade. The analysis results for the elements not quantified in the Table need not be reported unless the concentration level is greater than 0.1% each or 0.4% total.
[B]Lower hydrogen may be obtained by negotiation with the manufacturer.
[C]Need not be reported.
[D]A residual is an element present in a metal or an alloy in small quantities inherent to the manufacturing process but not added intentionally.
[E]The purchaser may, in his written purchase order, request analysis for specific residual elements not listed in this specification. The maximum allowable concentration for residual elements shall be 0.1% each and 0.4% maximum total.
[F]The percentage of titanium is determined by difference.

In making 6-4 alloy, one of the problems is the instability of $VCl_4$. $VCl_4$ is commonly transported as liquid vanadium tetrachloride, but liquid vanadium tetrachloride is unstable and decomposes to vanadium trichloride, the rate of decomposition being temperature dependent. Vanadium trichloride is less desirable as a feedstock for the Armstrong Process because it has a much higher melting and boiling point than vanadium tetrachloride. Moreover, decomposition of liquid tetrachloride to solid trichloride in a vanadium tetrachloride boiler adversely affects boiler performance due to the solids build up resulting in poor boiler pressure control, premature failure of boiler heaters, line plugging, loss of usable feedstock and excessive maintenance.

SUMMARY OF THE INVENTION

Accordingly, it is a principal object of the present invention to provide a method of and system for producing alloys using the Armstrong Process in which halides which are unstable can be injected as liquids into superheated vapor to form a mixture of gases for alloy production.

Another object of the invention is to provide a method of producing an alloy, comprising providing a flowing stream of superheated halide vapor, introducing one or more liquid halides into the flowing superheated halide vapor to vaporize the liquid halides forming a mixture of gases in predetermined and controllable ratios, introducing the mixture of gases into a flowing stream of liquid alkali or alkaline earth metal or mixtures thereof establishing a reaction zone wherein the mixture of gases is reduced to an alloy and a salt, the liquid metal being present in a sufficient amount in excess of stoichiometric to maintain substantially all the alloy and salt below the sintering temperatures thereof away from the reaction zone.

Another object of the present invention is to provide a method of producing a Ti base alloy, comprising providing a flowing stream of superheated titanium tetrahalide vapor, introducing one or more liquid halides into the flowing superheated titanium tetrahalide vapor to vaporize the liquid halides forming a mixture of gases in predetermined and controllable ratios, introducing the mixture of gases into a flowing stream of liquid alkali or alkaline earth metal or mixtures thereof establishing a reaction zone wherein the mixture of gases is reduced to a titanium base alloy and a salt, the liquid metal being present in a sufficient amount in excess of stoichiometric to maintain substantially all the titanium base alloy and salt below the sintering temperatures thereof away from the reaction zone.

A further object of the present invention is to provide a method of producing a Ti base alloy, comprising providing a flowing stream of superheated titanium tetrachloride vapor, introducing one or more liquid chlorides into the flowing superheated titanium tetrachloride vapor to vaporize the liquid chlorides forming a mixture of gases in predetermined and controllable ratios, introducing the mixture of gases into a flowing stream of liquid sodium or alkaline earth metal or mixtures thereof establishing a reaction zone wherein the mixture of gases is reduced to a titanium base alloy and salt, the liquid metal being present in a sufficient amount in excess of stoichiometric to maintain substantially all the titanium base alloy and salt below the sintering temperatures thereof away from the reaction zone.

A still further object of the present invention is to provide a system for producing an alloy, comprising a storage container for a first liquid halide and heating mechanism in communication therewith for providing a flowing stream of superheated halide vapor, a first detection and/or control device in communication with the flowing stream of superheated halide for detecting and/or controlling the mass flow rate thereof, a second storage container for a second liquid halide and mechanism in communication therewith for introducing the second liquid halide into the flowing stream of superheated halide vapor to vaporize the second liquid halide forming a mixture of gases in predetermined and controllable ratios, a second detection and/or control device in communication with the second storage container for the second liquid halide to measure and/or control the amount of second liquid halide introduced into the flowing superheated stream of halide, a storage container for a liquid alkali or alkaline earth metal and mechanism for providing a flowing stream of liquid alkali or alkaline earth metal or mixtures thereof and mechanism for introducing the mixture of gases into the flowing stream of liquid alkali or alkaline earth metal or mixtures thereof establishing a reaction zone wherein the mixture of gases is reduced to an alloy and salts, the liquid metal being present in a sufficient amount in excess of stoichiometric to maintain substantially all the alloy and salts below the sintering temperatures thereof away from the reaction zone, and control mechanism in communication with the first and second detection and/or control devices to control the amount of second liquid halide introduced into the flowing superheated stream of halide as a function of the mass flow rate of the superheated halide vapor to produce an alloy with predetermined constituent concentrations.

A final object of the invention is to provide a system for producing a Ti base alloy, comprising a storage container for liquid titanium tetrahalide and heating mechanism in communication therewith for providing a flowing stream of superheated titanium tetrahalide vapor, a first flow meter in communication with the flowing stream of superheated titanium tetrahalide for measuring the flow rate thereof, a second storage container for a second liquid halide and mechanism in communication therewith for introducing the second liquid halide into the flowing stream of superheated titanium tetrahalide vapor to vaporize the second liquid halide forming a mixture of gases in predetermined and controllable ratios, a second flow meter and/or a scale in communication with the second storage container for the second liquid halide to measure the amount of second liquid halide introduced into the flowing superheated stream of titanium tetrahalide, a storage container for a liquid alkali or alkaline earth metal and mechanism for providing a flowing stream of liquid alkali or alkaline earth metal or mixtures thereof and mechanism for introducing the mixture of gases into the flowing stream of liquid alkali or alkaline earth metal or mixtures thereof establishing a reaction zone wherein the mixture of gases is reduced to a titanium base alloy and salts, the liquid metal being present in a sufficient amount in excess of stoichiometric to maintain substantially all the titanium base alloy and salts below the sintering temperatures thereof away from the reaction zone, and control mechanism in communication with flow meters and/or the scale to control the amount of second liquid halide introduced into the flowing superheated stream of titanium tetrahalide to produce a titanium base alloy with predetermined constituent concentrations.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE INVENTION

Figure 1:
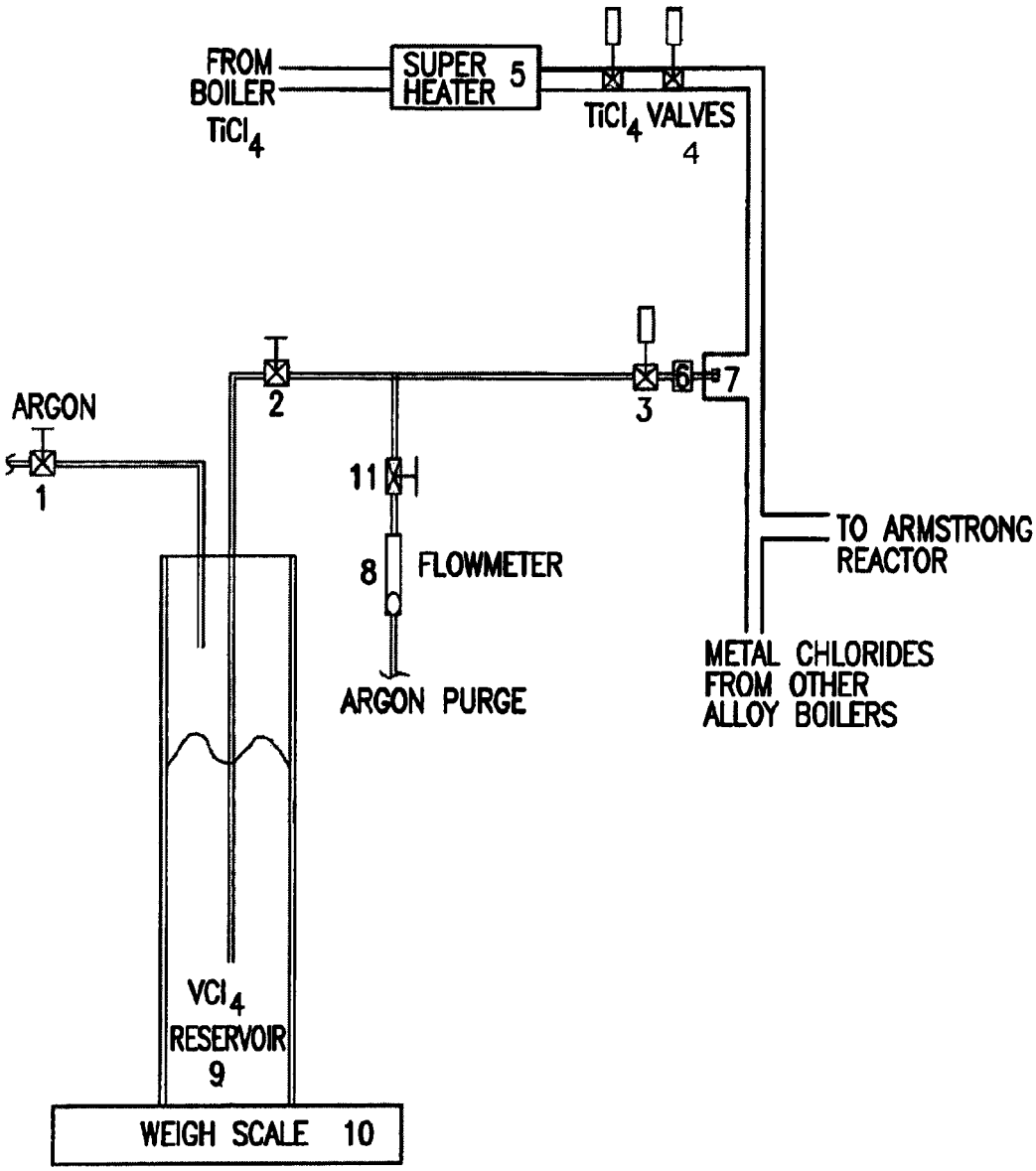
FIG. 1 is a schematic representation of a system for producing alloys according to the Armstrong Process incorporating the subject invention.

Because $VCl_4$ is a stable compound in the vapor form but decomposes when present as a liquid, the decomposition rate being both temperature and time dependent, the subject invention solves a difficult problem in making the most commercially useful titanium alloy. By introducing $VCl_4$ as a liquid, stored at a relatively low ambient temperature, directly into a super heated vapor without having to raise the temperature of the liquid over a longer period of time, significant losses of the $VCl_4$ feedstock are prevented. Moreover, as previously indicated, a host of other problems are also solved by the subject invention including equipment failure, poor control of the amount of vanadium introduced due to build up of solids in the vanadium boiler, increased maintenance and boiler failure.

All of the figures included in this application are non-limiting specific examples of the invention. Although the superheated vapor used in the specific example herein is $TiCl_4$ with optional aluminum trichloride intermixed therewith, the superheated vapor may be any halide or mixtures thereof that is suitable for the Armstrong process. Fluorides and borides are commercially available and for some alloy constituents may be required. The preferred halide is a chloride due to cost and availability. In general, the super heated halide may be one or more of titanium, vanadium, boron, antimony, beryllium, gallium, uranium, silicon and rhenium. In addition, one or more liquid halides of the following elements may be used as alloy constituents: Al, B, Be, Bi, C, Fe, Ga, Ge, In, Mo, Nb, P, Pb, Re, Sb, Si, Sn, Ta, Ti, V, and W. Certain halides sublimate rather than boil, so these, such as $AlCl_3$, $PtF_6$ and $ZrCl_4$, are introduced as vapor. The resulting alloy produced by this method and the system designed to provide same will include one or more of the following: Al, B, Be, Bi, C, Fe, Ga, Ge, Hf, In, Mo, Nb, P, Pb, Re, S, Sb, Si, Sn, Ta, Ti, U, V, W, and Zr. It should be noted that the alloy may contain non-metals such as carbon or boron or sulfur and in various amounts. The examples hereinafter set forth relate to titanium base alloys and particularly to titanium base alloys containing one or more of vanadium and aluminum but other alloys have been and are able to be made with the Armstrong Process. The introduction of some alloy constituents directly from the liquid has an additional advantage of facilitating the control of constituent concentrations.

Referring now to a non-limiting specific example, $VCl_4$ is a stable compound in vapor form but the decomposition of liquid $VCl_4$ is a problem when the liquid is heated beyond ambient temperatures in order to vaporize the same. The invention involves introducing a liquid halide into a super heated vapor stream of halides in order to flash the liquid $VCl_4$ to the vapor phase from ambient temperatures directly without heating the liquid to its boiling point over a long period of time resulting in the aforesaid decomposition.

With respect to titanium base alloys, a superheated stream of $TiCl_4$ can be used to flash vaporize liquids of vanadium chlorides and other halides facilitating improved control and reducing equipment problems in a vanadium tetrachloride boiler, as previously discussed. The amount of superheat needed is dependent among other things on the respective amount of superheated vapor and liquid halide being injected and can be determined by a person within the ordinary skill in the art when the constituents are known, based on the specific heat of the superheated vapor and the specific heat and heat of vaporization of the liquid. An example calculation specific to flash vaporizing $VCl_4$ with a superheated stream of $TiCl_4$ is set forth below.

Properties and Assumptions $TiCl_4$ Mass Flow Rate=2.5 Kg/min $VCl_4$ Mass Flow Rate=0.091 kg/min Cp $TiCl_{4gas}$=94.9 Joule/Mol-K @ 533K Cp $VCl_{4Eq}$=138.63 Joule/Mol-K @ 403K $H_{vap}$ $VCl_4$=33 kJoules/Mol-K @ 503K $VCl_4$ Mol Wt.=192.9 g $TiCl_4$ Mol Wt.=189.9 g Mol Wt V=50.9 g Mol Wt Ti=47.9 g Assume thermodynamic property variations are negligible over the temperature range considered (Ref. Chemical Properties Handbook, Carl L. Yaws, McGraw-Hill Handbooks).

To calculate the energy needed to vaporize the liquid $VCl_4$ @ 500 Kpa and 230° C. using the properties and assumption above, the following calculations are made: (This is the energy to heat the $VCl_4$ from 30° C. to 230° C. and the energy to vaporize the $VCl_4$) (mol $VCl_4$/0.1929 Kg)[(0.091 kg/60 sec)(138.6 J/mol-k)(230−30)+(0.091 kg/60 sec)(33 kj/mol)]=477j/sec needed to heat and vaporize the $VCl_4$ at 500 kPa and at the stated flow rate.

Calculate the necessary superheat on the $TiCl_4$ to provide the energy necessary to vaporize the $VCl_4$ at 500 Kpa:

$$(\text{Mass Flow}_{TiCl4\ Vap})(C_{pTiCl4\ Vap})(T_{TiCl4\ Superheated}-503\text{ k})=477\text{j/Sec}$$

$$(2.500\text{ kg/60 sec})(\text{mol TiCl}_4/0.1899\text{ kg})(94.9\text{ J/mol-K})(T_{TiCl4\ Superheated}-503\text{ k})=477\text{ j/sec}$$

$$T_{TiCl4\ Superheated}=525.8\text{K}=252.8°\text{ C.}$$

Thus, the superheat temperature above saturation required to provide the necessary energy to heat and vaporize the $VCl_{4liq}$ in this example is (252.8° C.−230° C.):=22.8° C. of superheat.

EXAMPLE 1

FIG. 1 is a schematic representation of the equipment used in the following example.

Referring now to FIG. 1, there is $VCl_4$ reservoir 9 connected by a valve 1 to a source of argon, the reservoir 9 being supported on a weigh scale 10. A conduit is below the liquid level of the $VCl_4$ in the reservoir 9 and extends through a series of valves 2 and 3 through a filter 6 into a gas manifold line 7. A separate argon purge is connected to the conduit leaving the $VCl_4$ reservoir by means of a valve 11 and a flow meter 8 to control the flow rate of argon purge gas after a run has been completed.

Titanium tetrachloride from a boiler (not shown) flows into a superheater 5 through a conduit past valves 4 into a manifold receiving liquid $VCl_4$ from the reservoir 9.

Figure 1A:
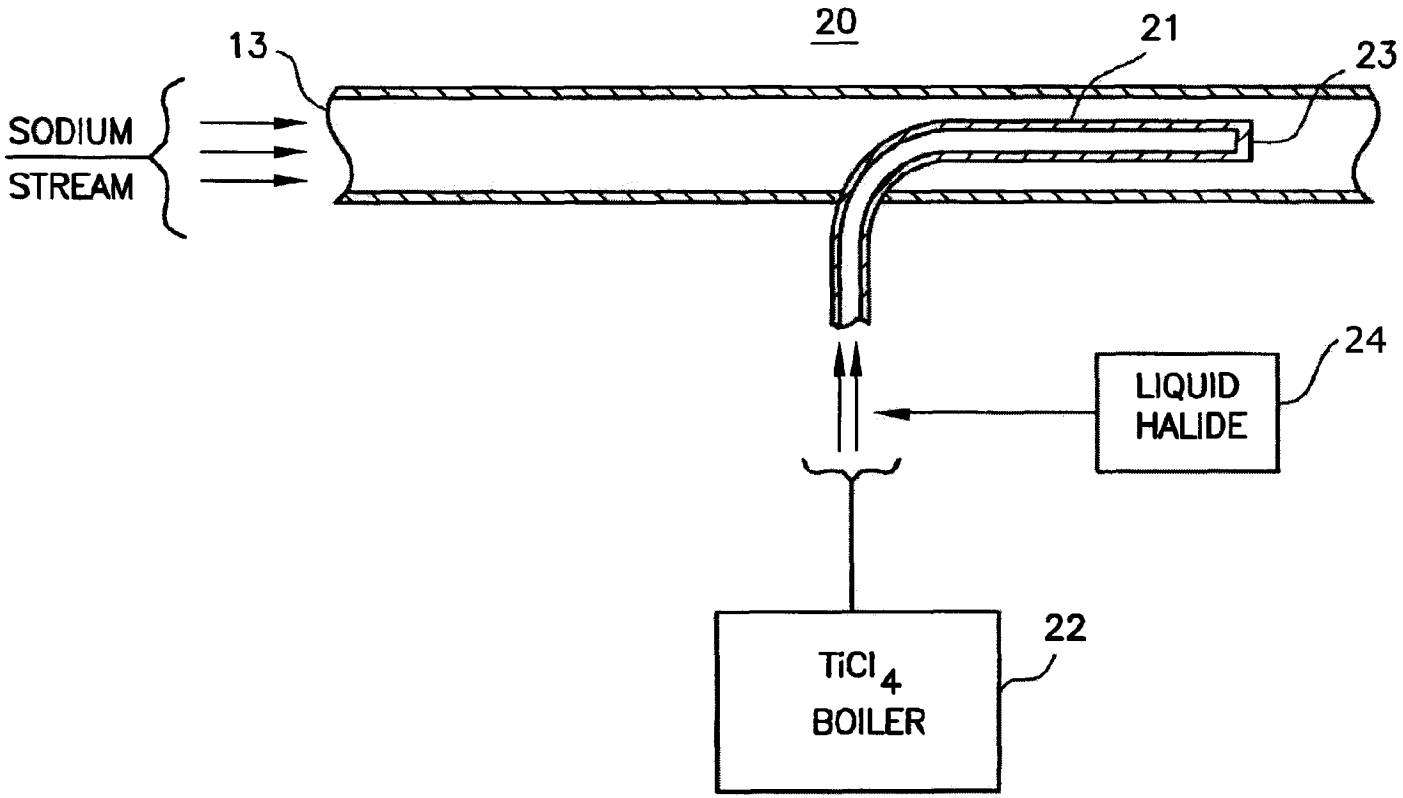
FIG. 1A is a schematic representation of a reactor useful in the practice of the invention.
Figure 2:
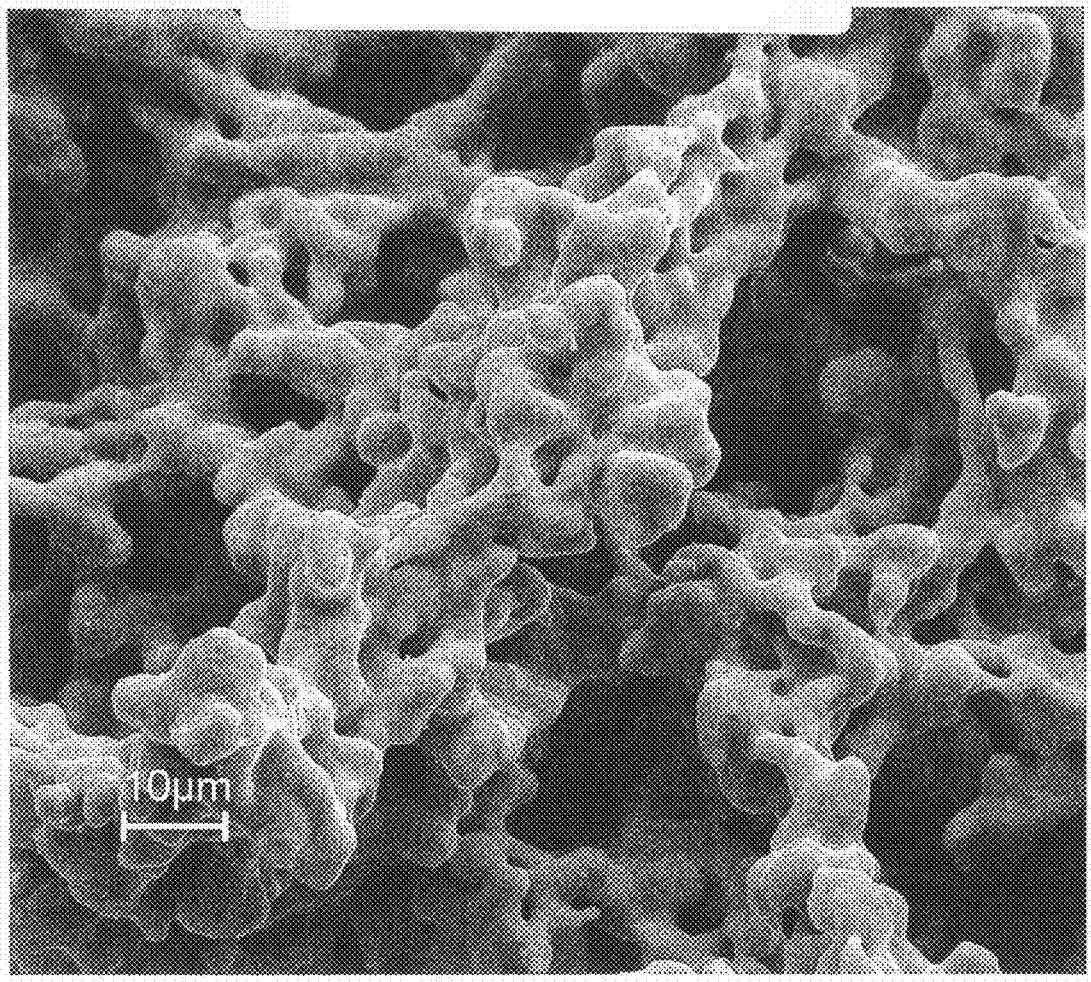
FIGS. 2-4 are SEMs of alloys made in accordance with the present invention.

Other chlorides for alloy constituents can be introduced into the manifold containing the gas as illustrated in FIG. 1 or at any point before the introduction of the liquid $VCl_4$. After the liquid $VCl_4$ is flashed to a vapor, the mixture of gases is then fed to the Armstrong reactor as illustrated in FIG. 1. FIG. 1A is a replication of the reactor as illustrated in FIG. 2 of U.S. Pat. No. 5,958,106, issued to Armstrong et al. Sep. 28, 1999, the entire disclosure of which was incorporated herein by reference. A reactor 20 has a liquid metal inlet 13 and a pipe 21 having an outlet or nozzle 23 connected to a source halide gas 22 ($TiCl_4$ Boiler) and source of halide liquid 24 (Liquid Halide).

For instance in FIG. 1A, the sodium entering the reaction chamber is at 200° C. having a flow rate of 38.4 kilograms per minute. The titanium tetrachloride from the boiler is at 2 atmospheres and at a temperature of 164° C., the flow rate through the line was 1.1 kg/min. Higher pressures may be used, but it is important that back flow be prevented, so the minimum pressure should be equal to or above that determined by the critical pressure ratio for sonic conditions, or about two times the absolute pressure of the sodium stream (two atmospheres if the sodium is at atmospheric pressure) is preferred to ensure that flow through the reaction chamber nozzle is critical or choked.

The description of the reactor in FIG. 1A is found in the previously incorporated Armstrong et al. patents. The difference between the reactor illustrated in FIG. 1A herein and that as described in the '106 and other patents incorporated herein is that the halide liquid that is flashed in this present invention is injected from the source (24) as a liquid into the titanium tetrachloride after it leaves the boiler 22 and superheater (5) under superheat conditions calculated in the manner hereinbefore described.

Referring to FIG. 1, a liquid reservoir of $VCl_4$ (9) is pressurized with Argon (1) to above the $TiCl_4$ vapor pressure so that liquid $VCl_4$ is capable of flowing into a pressurized $TiCl_4$ vapor stream at a constant rate. The rate can be varied by adjusting the reservoir pressure or the spray orifice diameter. When the reaction process is started, the $TiCl_4$ valves (4) open allowing superheated TiCl vapor to flow towards the reactor. Simultaneously, valve (3) opens allowing room temperature liquid $VCl_4$ to flow through filter (6) and spray nozzle (7) into the superheated $TiCl_4$ stream. The weigh scale 10 monitors $VCl_4$ mass flow rate into the process. The superheated $TiCl_4$ mixes with the liquid $VCl_4$, rapidly vaporizes it, and carries it to the Armstrong Reactor 20 (FIG. 1A) along with other metal chlorides from additional alloy boilers (not shown) to produce the desired powder. At the end of the run, the argon purge through flow meter (8) is used to drive out residual $VCl_4$ from the injection nozzle and tubing to prevent decomposition of residual $VCl_4$ plugging the delivery system.

Figure 5:
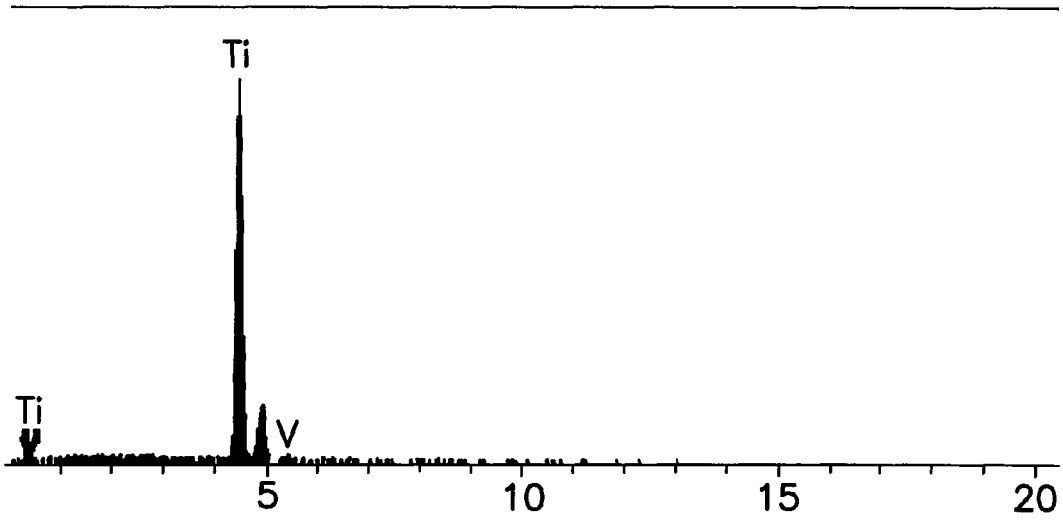
FIG. 5 is a plot of intensity versus energy level, in keV, for one spot of the alloy illustrated in the SEMs showing a small peak of about 5.3 keV is the $K_\beta$ emission for V.

In this example, $TiCl_4$ pressure was 500 Kpa and $VCl_4$ reservoir pressure was 2400 Kpa. During the course of the reaction, 232 g of liquid $VCl_4$ and 10,800 g of $TiCl_4$ with 80 to 100° C. superheat were injected. This corresponded to 61.3 g V and 2,728 g of Ti or 0.22 wt % V. The average chemical analysis showed a 0.23 wt % V in the powder demonstrating that the $VCl_4$ injected into the $TiCl_4$ stream made it into the reacted product. Further, X-ray mapping showed typical uniform distribution of the vanadium within the powder particles as shown in FIG. 5.

Using the equipment as shown in FIG. 1 with the addition of liquid $VCl_4$ flow control (PID) capability and the elimination of the spray nozzle (7) into the $TICl_4$ tube replaced by a ¼" tube leading directly into the superheated $TiCl_4$ vapor, a TiV alloy was produced. Based on actual $TiCl_4$ and $VCl_4$ weights reacted during a run, a 5.1 wt % vanadium content was expected in the titanium powder that was produced. The actual measured vanadium content produced during the test as measured by direct current plasma emission spectroscopy per ASTM E1097-03 varied from 4.95% to 5.27% over six different samples.

In this example, the control system was programmed to produce a Ti-4% V alloy as a function of actual $TiCl_4$ flow. The $TiCl_4$ pressure was approximately 500 kPa, the $VCl_4$ reservoir pressure was approximately 800 kPa, the $TiCl_4$ was superheated to greater than 285° C., the $TiCl_4$ flow indicated approximately 2200 g/min and the VCl flow indicated approximately 90 g/min. Based on actual weights of metal chloride reactants used during this run, the metal powder chemistry was expected to be between 4.1% and 4.2% vanadium. The vanadium concentrations are shown in Table 2.

TABLE 2

| Sample Identification | Vanadium % |
|---|---|
| B.01 | 4.30 |
| B.06 | 4.10 |
| B.03 | 4.10 |
| B.04 | 4.14 |
| B.05 | 4.11 |
| B.06 | 4.30 |

Method: Direct current plasma emission spectroscope—ASTM E 1097 03.

The Titanium (Ti)-Vanadium (V) alloy sample (©) was analyzed on a Zeiss Supra40VP Scanning Electron Microscope (SEM), a variable-pressure system with a PGT energy-dispersive X-ray detector. The secondary electron detector operating at 20 kV was used for the SEM micrographs shown in FIG. 2. This micrograph reveals typical Armstrong powder morphology with feature size similar to commercially pure (CP) Ti. Eleven spots were selected from an image similar to FIG. 2 for quantitative elemental analysis (spotlight). The individual results from this spotlight analysis are given in Table 3. The x-ray information showed a fairly uniform distribution of vanadium in titanium with an average value for V of 4.38%, see Table 3.

TABLE 3

Spotlight Summary Report Concentrations by Weight %

| Tag # C | Ti | V |
|---|---|---|
| 1 | 97.83% | 2.17% |
| 2 | 98.18% | 1.82% |
| 3 | 98.15% | 1.85% |
| 4 | 89.73% | 10.27% |
| 5 | 92.09% | 7.91% |
| 6 | 96.52% | 3.48% |
| 7 | 98.47% | 1.53% |
| 8 | 95.89% | 4.11% |
| 9 | 92.56% | 7.44% |
| 10 | 97.68% | 2.32% |
| 11 | 94.90% | 5.10% |
| | Average V | 4.38% |

Summary of the elemental concentrations derived from emission data for 11 random spots from an SEM image similar to FIG. 2.

Composition elemental mapping of the V concentration distribution in the titanium was performed using the K orbital x-ray emission data measure by a detector in the SEM. One issue in analyzing the x-ray emission information for a Ti—V alloy is that the $K_\alpha$ peak of V is near the Ti $K_\beta$ peak making it difficult to directly map elemental V based on the V $K_\alpha$ data. In order to get an elemental map of V, without the masking effect of the Ti $K_\beta$ peak, its $K_\beta$ peak was used. The $K_\alpha$ data for V is much weaker but is not confounded by other possible elements in this range.

Figure 3:
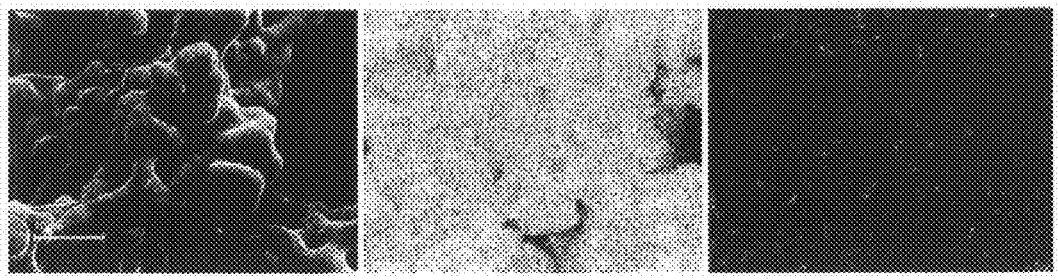
Figure 4:
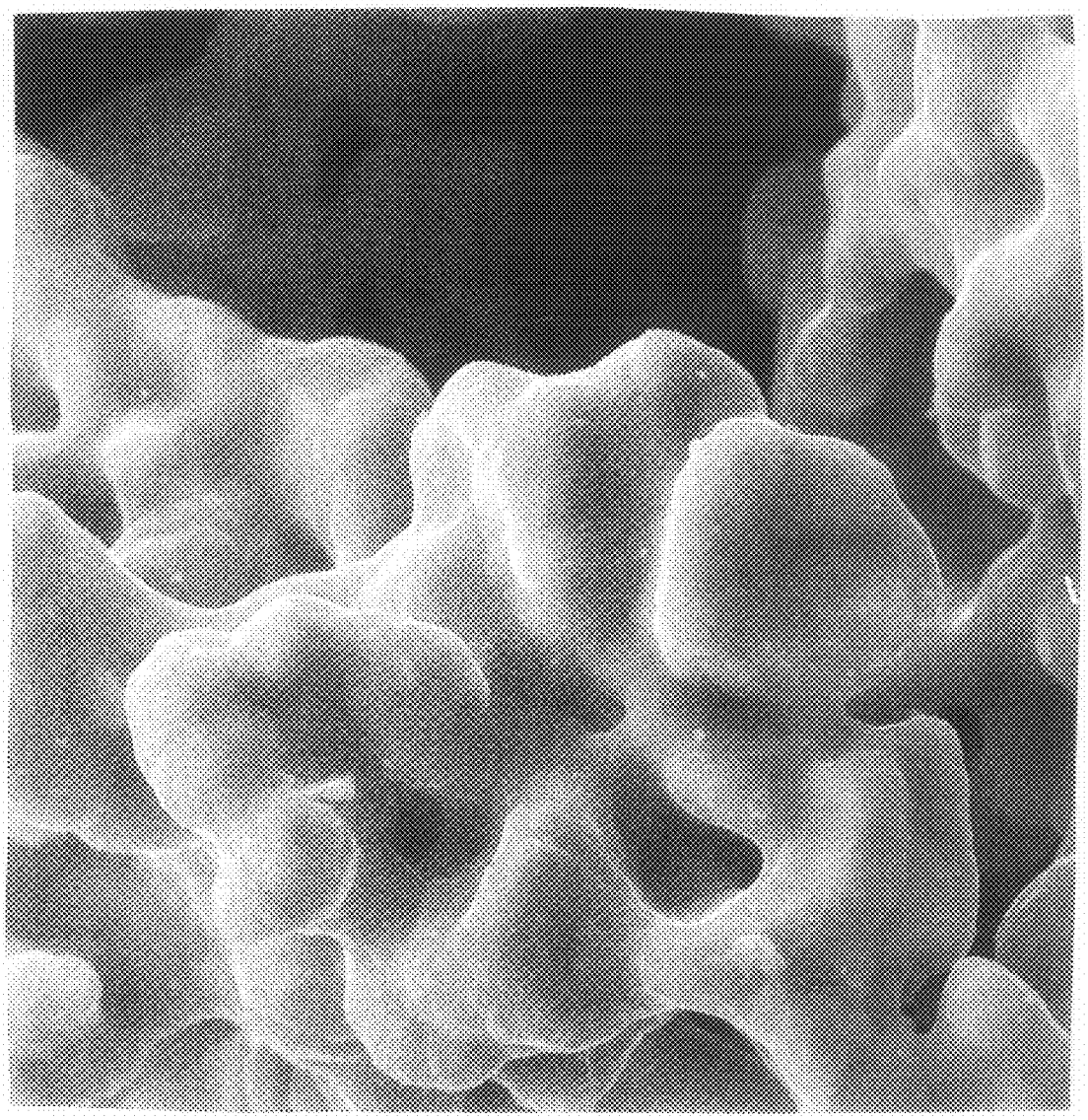

In FIG. 3 the secondary electron image is given along with the elemental mapping data for Ti and V based on $K_\alpha$ emission data. With the confounding of the Ti $K_\beta$ data at the same energy level as the V $K_\alpha$ the results may not give an accurate map of the V concentrations. The V $K_\beta$ peak was used to map the elemental concentration of V, as shown in FIG. 4. Since there are no other peaks masking the V $K_\beta$ peak, it is assumed that the V mapping results should be more accurate.

The intensity results of the x-ray energy emission for the Armstrong Ti-4V powder sample is given in FIG. 5. The high intensity peak at 4.51 keV is the $K_\alpha$ peak for Ti while the V $K_\alpha$ peak should appear at 4.95 keV, it is in part hidden by the secondary Ti $K_\beta$ peak at about 4.9 keV. The V $K_\beta$ peak however can be seen unabated at about 5.3 keV. Sample C (FIGS. 3 and 4) contains Ti—V powder with feature size similar to Armstrong CP Ti powder. X-ray analysis indicates minimal segregation of the V element in the Ti alloy.

Although the specific experiments or examples set forth above relate to titanium and vanadium, and more particularly, to the use of a titanium tetrachloride superheated vapor to flash vaporize ambient liquid vanadium tetrachloride, the invention extends beyond the specific examples and is not to be limited thereby. More specifically, a wide variety of superheated halides including mixtures thereof may be used in the subject invention including titanium, boron, antimony, beryllium gallium, uranium, silicon and rhenium to name a few. The liquid halide may include one or more of boron, beryllium, bismuth, carbon, iron, gallium, germanium, indium, molybdenum, niobium, phosphous lead rhenium, antimony, silicon, tin, tantalum, titanium vanadium and tungsten.

Moreover, more than one liquid halides may be introduced and more than one halide may be used as the superheated halide. In addition, the invention includes serial introduction of liquid halides and serial introduction of halide vapors. For instance, a titanium tetrachloride vapor may be superheated to flash vaporize a liquid such as but not limited to vanadium tetrachloride, and thereafter, additional halides such as those of bismuth, iron or any of the other previously named halides may be added as vapors or as liquids, as necessary.

The calculation for the amount of superheat needed is based on the examples hereinbefore set forth.

In order to make the most commercially useful alloy of titanium which is called 6-4 titanium, that is 6 percent by weight aluminum and 4 percent by weight vanadium with the balance titanium, aluminum trichloride has to be introduced into the titanium tetrachloride either before or after the liquid vanadium tetrachloride is flashed from liquid to vapor. The amounts of alloy constituents can be closely controlled using either the liquid or the vapor form, depending on instrumentation and the like. Other alloys can be made using the present invention including 6-4 titanium with boron additions as well as many other alloys.

While the invention has been particularly shown and described with reference to a preferred embodiment hereof, it will be understood by those skilled in the art that several changes in form and detail may be made without departing from the spirit and scope of the invention.

What is claimed is:

1. A method of producing an alloy, comprising the steps of:

introducing a liquid $VCl_4$ at ambient temperature into a flowing superheated halide vapor thereby vaporizing the liquid $VCl_4$ forming a mixture of gases, wherein the liquid $VCl_4$ has not been heated to boiling before being introduced into the flowing stream of superheated halide vapor; and introducing the mixture of gases into a flowing stream of a liquid metal comprising a liquid alkali metal or an alkaline earth metal or a mixture thereof establishing a reaction zone wherein the mixture of gases is reduced to an alloy and a salt, the liquid metal being present in a sufficient amount in excess of stoichiometric to maintain the alloy and salt below the sintering temperatures thereof away from the reaction zone after the mixture of gases is reduced to the alloy and salt.

2. The method of claim 1, wherein the superheated halide vapor comprises one or more of the halides of titanium, boron, antimony, beryllium, gallium, uranium, silicon, and rhenium.

3. The method of claim 1, wherein the superheated halide vapor comprises $TiCl_4$.

4. The method of claim 1, wherein the superheated halide vapor mixture contains a metal halide and a non-metal halide.

5. The method of claim 2, wherein the halides are chlorides.

6. The method of claim 1, wherein the alloy is a base alloy of one or more of titanium, boron, antimony, beryllium, gallium, uranium, silicon, and rhenium.

7. The method of claim 1, wherein the liquid metal is selected from the group consisting of Na, K, Mg, Ca and mixtures thereof.

8. The method of claim 7, wherein the liquid metal is Na.

9. The method of claim 7, wherein the temperature of the liquid metal away from the reaction zone is maintained at less than about 600° C.

10. The method of claim 1, wherein the alloy comprises Al.

11. A method of producing a Ti base alloy, comprising the steps of:

introducing a liquid $VCl_4$ at ambient temperature into a flowing superheated titanium tetrahalide vapor thereby vaporizing the liquid $VCl_4$ forming a mixture of gases, wherein the liquid $VCl_4$ has not been heated to boiling before being introduced into the flowing superheated titanium tetrahalide vapor; and introducing the mixture of gases into a flowing stream of a liquid metal comprising a liquid alkali metal or an alkaline earth metal or a mixture thereof establishing a reaction zone wherein the mixture of gases is reduced to a titanium base alloy and a salt, the liquid metal being present in a sufficient amount in excess of stoichiometric to maintain the titanium base alloy and salt below the sintering temperatures thereof away from the reaction zone after the mixture of gases is reduced to the titanium base alloy and salt.

12. The method of claim 11, wherein the flowing superheated titanium tetrahalide vapor comprises titanium tetrachloride.

13. The method of claim 11, wherein the mixture of gases comprises aluminum chloride.

14. The method of claim 13, wherein the titanium base alloy contains about 6% aluminum and about 4% vanadium within ASTM B265, grade 5 specifications for 6-4 Ti.

15. The method of claim 11, wherein at least some of the vanadium tetrachloride is provided as vanadium tetrachloride in a container under an inert gas atmosphere prior to the introduction thereof into the flowing superheated titanium tetrahalide vapor mixture.

16. The method of claim 15, wherein the gas pressure in the container exceeds the vapor pressure of the flowing superheated titanium tetrahalide vapor mixture and is used at least in part to control a flow rate of the vanadium chloride into the flowing superheated titanium tetrahalide vapor mixture.

17. The method of claim 11, wherein the amount of liquid $VCl_4$ introduced into the flowing superheated titanium tetrahalide vapor mixture is controlled at least in part by measuring the flow rate of the flowing superheated titanium tetrahalide vapor mixture.

18. The method of claim 11, wherein the liquid metal is selected from the group consisting of Na, K, Mg, Ca and mixtures thereof.

19. The method of claim 11 wherein the liquid metal is Na.

20. A method of producing a Ti base alloy, comprising the steps of:

introducing a liquid $VCl_4$ at ambient temperature into a flowing stream of superheated $TiCl_4$ vapor thereby vaporizing the liquid $VCl_4$ forming a mixture of gases, wherein the liquid $VCl_4$ has not been heated to boiling before being introduced into the flowing stream of superheated $TiCl_4$ vapor; and introducing the mixture of gases into a flowing stream of a liquid metal comprising a liquid alkali metal or an alkaline earth metal or a mixture thereof establishing a reaction zone wherein the mixture of gases is reduced to a Ti base alloy and salt, the liquid metal being present in a sufficient amount in excess of stoichiometric to maintain the Ti base alloy and salt below the sintering temperatures thereof away from the reaction zone after the mixture of gases is reduced to the Ti base alloy and salt.

21. The method of claim 20 wherein the mixture of gases comprises $AlCl_3$.

22. The method of claim 20, wherein the Ti base alloy comprises about 6% aluminum and about 4% vanadium within ASTM B265, grade 5 specifications for 6-4 Ti alloy.

* * * * *

UNITED STATES PATENT AND TRADEMARK OFFICE

CERTIFICATE OF CORRECTION

PATENT NO. : 9,127,333 B2
APPLICATION NO. : 11/789641
DATED : September 8, 2015
INVENTOR(S) : Lance Jacobsen and Adam Benish It is certified that error appears in the above-identified patent and that said Letters Patent is hereby corrected as shown below:

In the Specification:

Column 5, line 65: Delete "Cp $VCl_{4Eq}$" and replace with -- Cp $VCl_{4liq}$ --

Signed and Sealed this
Ninth Day of February, 2016

Michelle K. Lee

Michelle K. Lee
*Director of the United States Patent and Trademark Office*